US006715643B1

(12) United States Patent
Kelly

(10) Patent No.: US 6,715,643 B1
(45) Date of Patent: Apr. 6, 2004

(54) DEVICE AND METHOD FOR DISPENSING CHEMICAL PRODUCT

(76) Inventor: J. Keith Kelly, 2411 Broughton Rd., Newborn, GA (US) 20056

( * ) Notice: Subject to any disclaimer, the term of this patent is extended or adjusted under 35 U.S.C. 154(b) by 0 days.

(21) Appl. No.: 09/818,889

(22) Filed: Mar. 28, 2001

(51) Int. Cl.[7] ..... B67D 5/00; B67D 5/42; B65D 35/28

(52) U.S. Cl. ..... 222/82; 222/95; 222/389; 239/323

(58) Field of Search ..... 222/394, 395, 222/400.7, 88, 83.5, 82, 386.5, 389, 105, 95, 107, 81, 91; 239/310, 337, 373, 272, 323

(56) References Cited

U.S. PATENT DOCUMENTS

| | | | | | |
|---|---|---|---|---|---|
| 1,674,515 | A | * | 6/1928 | Johnson | 222/386.5 |
| 2,723,161 | A | * | 11/1955 | Covington | 222/386.5 |
| 3,662,929 | A | * | 5/1972 | Sims | 222/386.5 |
| 4,034,896 | A | | 7/1977 | Wilson | 222/95 |
| D280,924 | S | | 10/1985 | Smith | D23/18 |
| D281,899 | S | | 12/1985 | Gunzel, Jr. et al. | D23/18 |
| D296,229 | S | | 6/1988 | Cunning | D23/214 |
| 4,782,982 | A | | 11/1988 | Ellison | 222/1 |
| 4,930,664 | A | | 6/1990 | Ellison | 222/1 |
| 4,930,686 | A | | 6/1990 | Ellison | 222/394 |
| 5,064,170 | A | | 11/1991 | Feyen | 251/344 |
| 5,072,884 | A | | 12/1991 | Ellison et al. | 239/373 |
| 5,240,144 | A | * | 8/1993 | Feldman | 222/105 |
| 5,301,877 | A | | 4/1994 | Madison | 239/154 |
| 5,307,995 | A | | 5/1994 | Jackson et al. | 239/373 |

* cited by examiner

*Primary Examiner*—Kevin Shaver
*Assistant Examiner*—Stephanie L. Willatt
(74) *Attorney, Agent, or Firm*—McKenna Long & Aldridge LLP

(57) ABSTRACT

A chemical dispensing system including a reservoir, a collapsible container inserted in the reservoir, the reservoir being sealed after the collapsible container has been inserted into the reservoir. A valve is configured to conduct fluid from an external source to a volume formed by the exterior of the collapsible container and the interior of the reservoir. A connecting tube is configured to conduct product from the collapsible container to an applicator when water is provided to the reservoir.

16 Claims, 4 Drawing Sheets

DEVICE AND METHOD FOR DISPENSING CHEMICAL PRODUCT

BACKGROUND OF THE INVENTION

1. Field of the Invention

The present invention relates to a device and method for dispensing a chemical product, and more particularly, to a chemical dispensing system for expelling a ready-to-use chemical product from a collapsible bag by means of fluid pressure.

2. Discussion of Related Art

Typically, devices for applying a chemical product, such as garden sprayers, include a means for pressurizing the contents of a product tank. For example, a hand-held sprayer, as shown in U.S. Pat. Des. 296,229, provides pressure to liquid in a supply tank by means of a hand- or finger-operated pump, thereby forcing the liquid through the sprayer dispenser.

Other sprayers provide pressurization by means of an external source of pressure, such as water or air. Air is typically added by means of an inlet port which connects to a pressurization pump, as disclosed in U.S. Pat. No. 5,072,884.

Other known sprayers provide pressurization by means of addition of water to a closed container containing the chemical product, to force the product out of a dispenser. Typically, the liquid, usually water, is mixed with the chemical product in the closed container to produce a water solution, which is then applied by means of the sprayer. Therefore, the resultant solution is a dilution of the chemical product contained in the closed container. Examples of such dilution sprayers include those shown in U.S. Pat. Nos. 4,782,982; 4,930,664; 4,930,686; and U.S. Pat. Des. 281,299.

Connectors and valves have been developed to allow connection between a pressurizing hose and a closed container to form a dilution sprayer. Examples of such connectors and valves are disclosed in U.S. Pat. Nos. 5,064,170; 5,307,887; 5,307,995; and U.S. Pat. Des. 280,924.

An additional means of supplying pressurization is by way of a flexible diaphragm, as disclosed in U.S. Pat. No. 4,034,896. The flexible diaphragm disclosed in U.S. Pat. No. 4,034,896, is disposed between an upper half and a lower half of an elliptical sprayer container. A chemical to be dispensed is placed in one half of the elliptical container. A garden hose is attached to the other half of the elliptical container. As water is added to the other half of the elliptical container, the flexible diaphragm moves into the half of the container containing the chemical, pressurizing that half by reducing its volume. As the volume decreases, the chemical product is forced from the container. However, this diaphragm device suffers the problem that the chemical must be poured into the container, and mixed with water as necessary before applying.

In the known devices, the chemical applicator tank must be cleaned after use to remove chemical residue from the interior of the tank. In many of the known applicator devices, this cleaning is cumbersome or ineffective because the opening to the chemical applicator tank is too narrow.

For example, in the device disclosed in U.S. Pat. No. 4,034,896, the half of the container that contained the chemical must be cleaned after use. The disclosed method of cleaning the container is to flush the container with water during the next use, in which the elliptical container is flipped over so that the half that held the chemical product is now used to add water pressure, and the half that previously held water to increase pressure is used for chemical. This process is cumbersome and presumes that the user will continue to repeatedly use the sprayer system. If the user stops alternatively applying chemical, he must then rinse the half of the container which contained chemical applying water separately, perhaps requiring removal of the garden hose from the other half of the container. This would involve turning of the water at its source, removing the hose from the pressurizing side of the container, and applying the hose to the other side of the container. The water must be emptied from the pressurizing side or capped to prevent spilling the water in the pressurizing side while the hose is being transferred to the chemical side of the container for rinsing.

One problem present in all of the above devices is the necessity that the chemical for application must be placed in the chemical applicator tank by the user, typically by pouring from the container in which the chemical is provided from the manufacture. In many of the known devices, this procedure is messy and cumbersome.

Often the chemical must then be diluted with water, either manually or by diluting it with the same liquid used to pressurize the device. Concentration of the diluted product may vary depending on how the amount of liquid added to the chemical, and it is difficult for a use to accurately control the concentration to a desired ratio. Moreover, the product solution may be inconsistent in its concentration if the user does not mix the solution thoroughly or the pressurizing liquid is supplied too quickly to the chemical applicator tank.

SUMMARY OF THE INVENTION

Accordingly, the present invention is directed to a device for dispensing a chemical product and a method therefor that substantially obviate one or more of the problems due to limitations and disadvantages of the related art.

An object of the present invention is to provide a bag-in-bottle, ready-to-use (RTU) chemical dispensing system using fluid pressure as a means to collapse a product bag containing a chemical product, thereby expelling the contents of the product bag through an applicator.

A further object of the present invention is to provide a bag-in-bottle, RTU chemical dispensing system having a valve cover that allows for discontinuing the supply of pressurizing fluid to the applicator.

A further object of the present invention is to provide a bag-in-bottle RTU chemical dispensing system having a valve cover that allows for rinsing of the applicator reservoir using the pressurizing fluid.

A further object of the present invention is to provide a bag-in-bottle, RTU chemical dispensing system which provides premixed chemical product in sealed ready-to-use product bags configured to be inserted unopened into the chemical dispensing system.

A further object of the present invention is to provide a method for applying a chemical product including the steps of providing a chemical product in a sealed collapsible container, placing the sealed collapsible container in a sealable reservoir, piercing the collapsible container to provide an opening, providing fluid between the exterior of the collapsible container and the reservoir to push product from the collapsible container.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention includes a device for dispensing a chemical product, comprising: a reservoir; a collapsible container configured to be inserted in the reservoir, the reservoir being sealed after the collapsible container is inserted to the reservoir; an applicator; a connecting tube configured to conduct product from the collapsible container to the applicator; and a valve configured to conduct fluid from an external source to a volume formed by the exterior of the collapsible bag and the interior of the reservoir.

Another aspect of the present invention includes a valve to control the output of the dispensing system.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this application, illustrate embodiments of the inventing and together with the description serve to explain the principles of the invention.

FIG. 1*a* is a cross-sectional top view of the valve cover of the chemical dispensing device of the present invention in a dispense configuration.

FIG. 1*b* is a cross-sectional view of the chemical dispensing device of the present invention in the dispense configuration.

FIG. 2*a* is a cross-sectional top view of the valve cover of the chemical dispensing device of the present invention in an off configuration.

FIG. 2*b* is a cross-sectional view of the chemical dispensing device of the present invention in the off configuration.

FIG. 3*a* is a cross-sectional top view of the valve cover of the chemical dispensing device of the present invention in a rinse configuration.

FIG. 3*b* is a cross-sectional view of the chemical dispensing device of the present invention in the rinse configuration.

DETAILED DESCRIPTION OF PREFERRED EMBODIMENTS

Reference will now be made in detail to the preferred embodiments of the present invention, examples of which are illustrated in the accompanying drawings.

In a preferred embodiment of the present invention, a valve cover incorporating a rotary valve allows a device for dispensing a chemical product to be in one of three configurations: "dispense," "off," and "rinse," as shown in FIGS. 1*a* and 1*b*, 2*a* and 2*b*, and 3*a* and 3*b*, respectively.

Figure 1A:
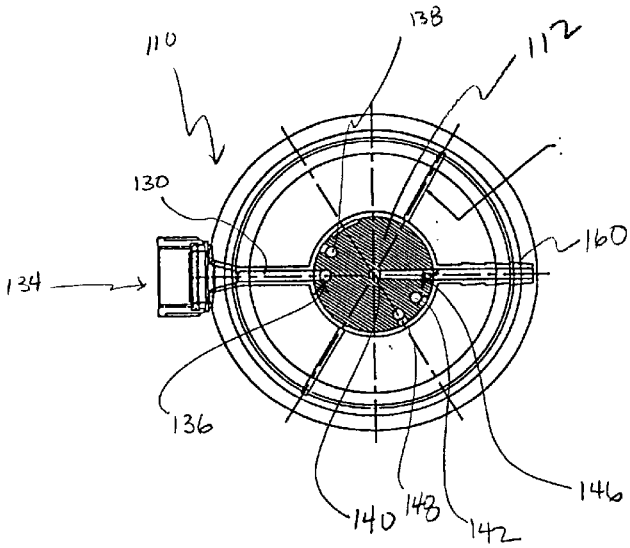
Figure 1B:
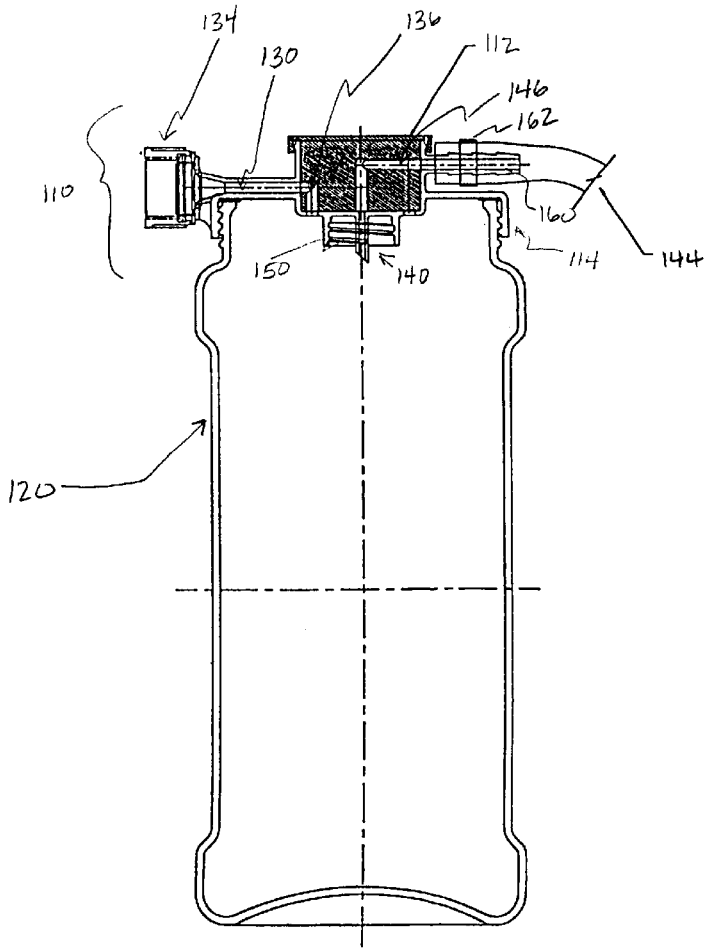
Figure 2A:
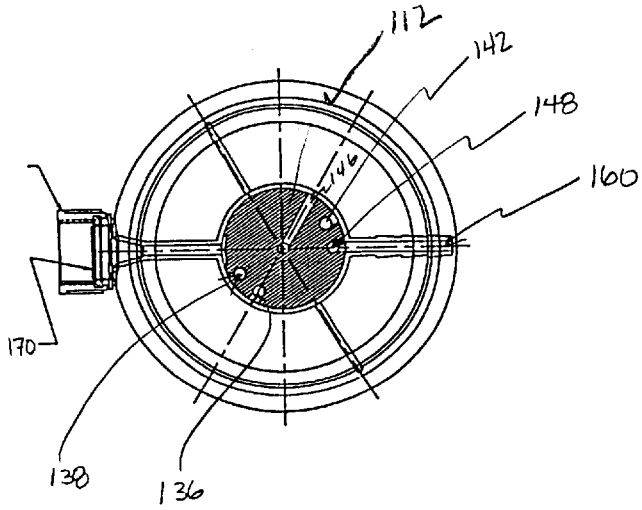
Figure 2B:
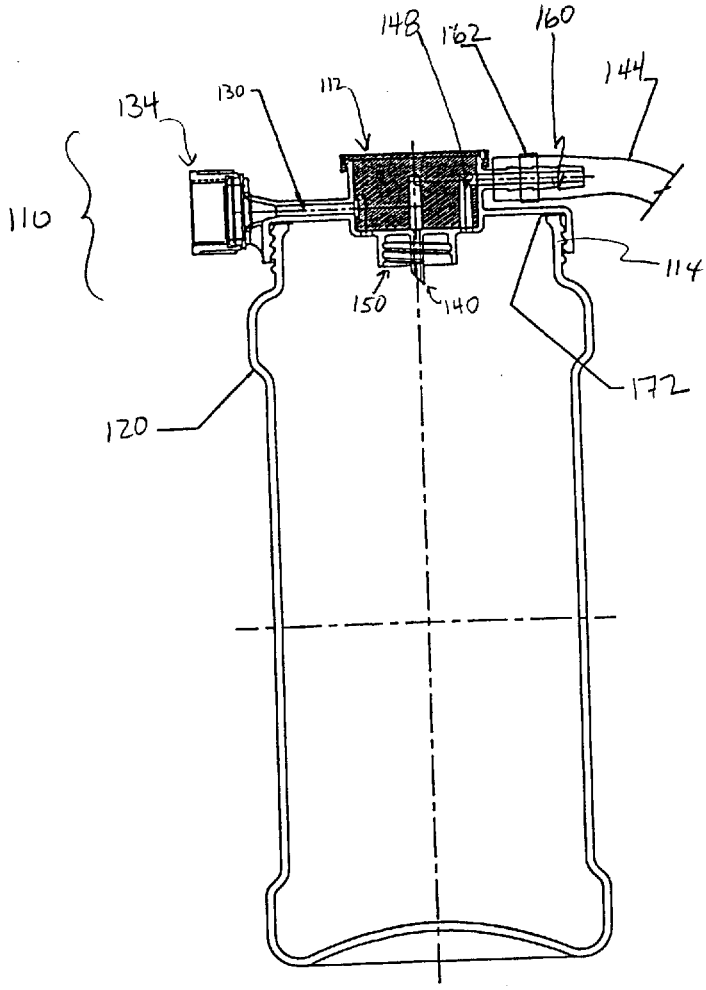
Figure 3A:
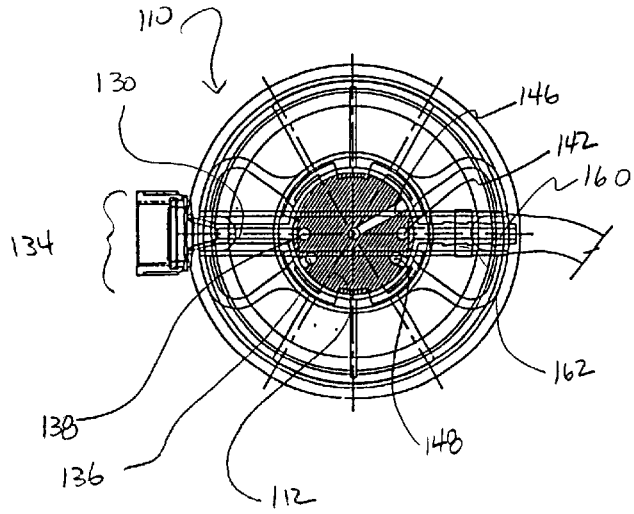
Figure 3B:
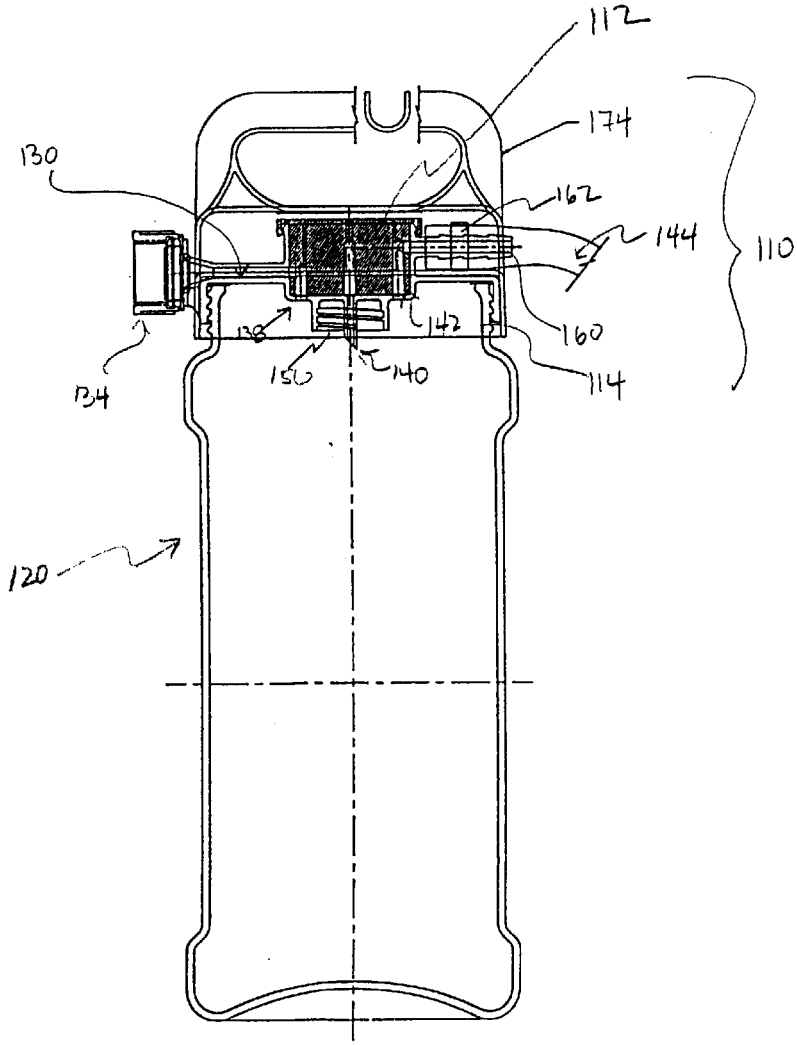

FIGS. 1*a* and 1*b* show a preferred embodiment of the present invention in the "dispense" configuration. FIGS. 2*a* and 2*b* show a preferred embodiment of the present invention in the "off" configuration. FIGS. 3*a* and 3*b* show a preferred embodiment of the present invention in the "rinse" configuration.

Figure 4:
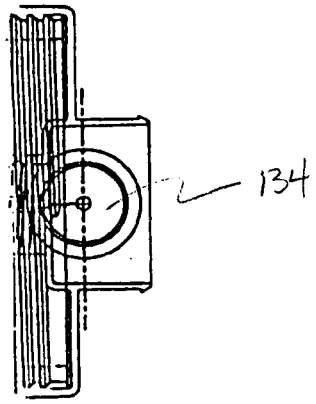
FIG. 4 is a cross-sectional view of a hose attachment according to one embodiment of the present invention.

As shown in FIGS. 1*b*, 2*b*, and 3*b*, a valve cover 110, is removably attached to a rigid reservoir 120. The valve cover 110 may be attached to the reservoir 120 by a threaded head arrangement 114. The rigid reservoir 120 is adapted to hold a collapsible container, such as a product bag or pouch (not shown). The product bag contains a ready-to-use chemical product, e.g., a lawn treatment, such as an herbicide, fertilizer, or a combination herbicide/fertilizer. The valve cover 110 includes an intake port 130 connected to a hose attachment 134. The hose attachment 134 allows for connection to a standard garden hose (not shown). FIG. 4 shows one configuration of the hose attachment 134 according to the preferred embodiment. The hose attachment 134 may be configured to swivel. The valve cover 110 connects to applicator wand 144. As shown in FIGS. 1*b*, 2*b*, and 3*b*, the valve cover 110 may include a barbed nipple connection 160 to removably engage hose clamp 162 of applicator wand 144.

The valve cover further includes a valve 112. The valve 112 includes an intake connection port 136, a rinse connection port 138, a hollow piercing tube 140, a rinse outlet port 142, an expellant port 146, and an off vent port 148. The reservoir 120 may also include a thread head 150 for attaching the valve 112 and the valve cover 110 to the reservoir 120.

In a preferred embodiment of the present invention, the valve 112 is rotatable to place the dispensing device of the present invention in one of the three configurations: "dispense," "off," and "rinse."

In the dispense configuration shown in FIGS. 1*a* and 1*b*, the valve cover 110 is placed on the reservoir 120 containing a collapsible container such as a product bag (not shown). The hollow piercing tube 140 punctures the exterior of the collapsible product bag through a seal to connect the interior of the collapsible product bag to the applicator wand 144 through the piercing tube 140 and the expellant port 146. In a preferred embodiment of the present invention, the piercing tube 140 punctures the seal of the collapsible product bag as the valve cover 110 is threaded onto the reservoir 120 containing the collapsible product bag.

In the "dispense" configuration of FIGS. 1*a* and 1*b*, the valve 112 is rotated to connect the intake port 130 to the reservoir 120 through intake connection point 136 and to connect the hollow piercing tube 140 to applicator wand 144 through expellant port 146.

In the "off" configuration shown in FIGS. 2*a* and 2*b*, the valve cover 110 is placed on the reservoir 120. It is contemplated that the reservoir 120 may or may not contain the collapsible product bag. It is also contemplated that the reservoir 120 may contain a product bag containing product, an empty product bag (after the product has been expelled), or a partially empty product bag. In the "off" configuration, as shown in FIGS. 2*a* and 2*b*, the intake port 130 is blocked by the side wall of the valve 112 so that the intake port 130 does not connect to the reservoir 120. The off vent port 148 connects the reservoir 120 to the applicator wand 144 to vent the interior of the reservoir 120 through the applicator wand 144. It is also contemplated that the off vent port 148 may vent through the top of the valve 112 instead of through the applicator wand 144. In the "off" configuration shown in FIGS. 2*a* and 2*b*, the hollow piercing tube 140 is disconnected from the intake port 130 and the expellant port 146, and is thus disconnected from the applicator wand 144.

Because the intake port 130 is blocked from the reservoir 120 by the valve 112, no fluid enters the reservoir 120. Thus, no additional pressure is applied to the product bag to collapse it further and expel product from the bag. Moreover, because the product bag is disconnected from the expellant port 146 and the applicator wand 144, no additional product may be expelled from the product bag.

In the "rinse" configuration shown in FIGS. 3*a* and 3*b*, the valve cover 110 is placed on the reservoir 120. It is contemplated that the reservoir 120 may or may not contain the collapsible product bag (not shown). It is also contemplated that the reservoir 120 may contain a product bag containing product, an empty product bag (after the product has been expelled), or a partially empty product bag. In the "rinse" configuration, as shown in FIGS. 3*a* and 3*b*, the intake port 130 connects to the rinse connection port 138 to provide fluid from the intake port 130 to the interior of the reservoir 120. The rinse outlet port 142 connects the reservoir 120 to the applicator wand 144 to vent fluid from interior of the reservoir 120 through the applicator wand 144. In practice, the rinse outlet port 142 and the off vent port 148 may be the same port.

In the "rinse" configuration shown in FIGS. 3*a* and 3*b*, the hollow piercing tube 140 is disconnected from the intake port 130 and the expellant port 146, and is thus disconnected from the applicator wand 144.

Figure 5:
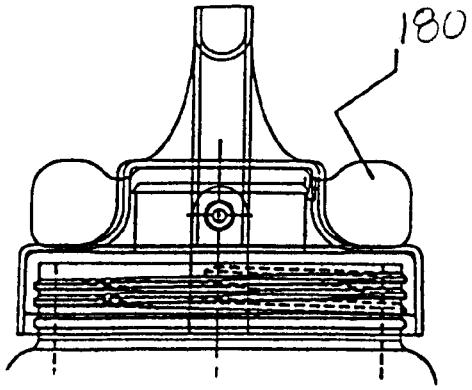
FIG. 5 is a side view of a valve cover according to one embodiment of the present invention.

As shown in FIG. 2*a*, the hose attachment 134 may include an anti-siphon cap or a diaphragm 170. As shown in FIG. 2*b*, a foam liner 172, may be used to seal the valve cover 110 on the reservoir 120. As shown in FIG. 3*a*, the valve cover 110 may include a handle or removable cover 174. The handle 174 may be used to operate the rotatable valve 112. As shown in FIG. 5, the valve cover 110 may include valve actuator tabs 180 to facilitate operation of the rotatable valve 112.

In the "dispense" configuration, a collapsible product bag is placed inside the reservoir 120. The valve cover is attached to the reservoir to seal the interior of the reservoir. The collapsible product bag is pierced by the hollow piercing tube 140 to allow product in the bag to be expelled through the hollow piercing tube 140, through the expellant tube 146 to the applicator wand 144. Product is expelled from the collapsible product bag by applying fluid pressure to the exterior of the product bag within the reservoir 120 to collapse the product bag, forcing product through the hollow piercing tube 140, through the expellant tube 146 to the applicator wand 144.

A standard water hose, such as a garden hose, is attached to the dispensing device at the hose attachment 134. For example, a standard garden hose nozzle may be threaded to the hose attachment 134. To dispense the product from the product bag, fluid, for example, water, is provided to the reservoir 120 through the hose attachment 134, the intake port 130, and the connection port 136 to fill the reservoir between interior wall of the reservoir 120 and the exterior surface of the collapsible product bag. As the reservoir 120 fills with fluid, the fluid pressure increases, causing the product bag to collapse, forcing product from the bag into the hollow piercing tube 140. If the valve 112 is in the "dispense" configuration, the product is forced from the hollow piercing tube 140 into the expellant tube 146 and out through the applicator wand 144.

If the valve 112 is in the "off" position, even if fluid is provided through the hose attachment 134, the intake port 130 is blocked by the valve 112, and no additional fluid is provided to the reservoir 120. Therefore, the pressure on the product bag does not increase and no product is expelled from the product bag.

If the valve 112 is in the "rinse" position, fluid from the hose attachment 134 is provided to the reservoir 120 through rinse connection port 138. The fluid provided to the reservoir 120 is expelled through the applicator wand 144 via rinse outlet port 142.

It will be apparent to those skilled in the art that various modifications and variations can be made in the device and method for dispensing chemical product as described herein, without departing from the spirit or scope of the present invention. Thus, it is intended that the present invention cover the modifications and variations of this invention provided they come within the scope of the appended claims and their equivalents.

What is claimed is:

1. A device for dispensing chemical product, comprising:

a reservoir;

a collapsible container configured to be inserted into the reservoir;

a rotatable valve cover, configured to be removably attached to the reservoir, the valve cover including an intake tube connected to receive fluid from an external source, a piercing tube configured to be inserted through a portion of the collapsible container inserted in the reservoir when said valve cover is attached to the reservoir, and an expellant port connected to conduct chemical product from the piercing tube; and a valve including a vent port, the valve being adaptable to interpose the vent port between the expellant port and the reservoir.

2. The device of claim 1, further comprising:

a valve including a first portion of the intake tube, the valve being adaptable to interpose the first portion of the intake tube between a second portion of the intake tube and the reservoir.

3. The device of claim 1 further comprising:

a valve including a first portion of the expellant port, the valve being adaptable to interpose the first portion of the expellant port between a second portion of the expellant port and the piercing tube.

4. The device of claim 1, further comprising:

a valve including a first portion of the intake tube, the valve being adaptable to interpose the first portion of the intake tube between a second portion of the intake tube and the reservoir, and to interpose the first portion of the expellant port between a second portion of the expellant port and the piercing tube.

5. The device of claim 1, further comprising:

a valve including a side wall, the valve being adaptable to interpose the side wall between the intake tube and the reservoir.

6. The device of claim 1, further comprising: a valve including a vent port, the valve being adaptable to interpose the vent port between the expellant port and the reservoir, and to interpose a side wall between the intake tube and the reservoir.

7. The device of claim 1, wherein the reservoir comprises a rigid bottle.

8. A device for dispensing chemical product, comprising:

a reservoir;

a collapsible container configured to be inserted into the reservoir;

a rotatable valve cover, configured to be removably attached to the reservoir, the valve cover including an intake tube connected to receive fluid from an external source, a piercing tube configured to be inserted through a portion of the collapsible container inserted in the reservoir when said valve cover is attached to the reservoir, and an expellant port connected to conduct chemical product from the piercing tube;

a valve including a rinse connection port, the valve being adaptable to interpose the rinse connection port between the intake tube and the reservoir and to interpose a vent port between the expellant port.

9. A device for dispensing chemical product, comprising:

a reservoir;

a collapsible container configured to be inserted into the reservoir;

a rotatable valve cover, configured to be removably attached to the reservoir, the valve cover including an intake tube connected to receive fluid from an external source, a piercing tube configured to be inserted through a portion of the collapsible container inserted in the reservoir when said valve cover is attached to the reservoir, and an expellant port connected to conduct chemical product from the piercing tube;

a valve including a rinse connection port, the valve being adaptable to interpose the rinse connection port between the intake tube and the reservoir and to interpose the vent port between the expellant port.

10. A system for dispensing a product, comprising:

a reservoir for receiving a collapsible container;

a valve cover, configured to be removably attached to the reservoir, the valve cover including an intake tube connected to receive fluid from an external source, a piercing tube configured to be inserted through a portion of the collapsible container received by the reservoir when said valve cover is attached to the reservoir, and an expellant port connected to conduct product from the piercing tube; and a valve including a vent port, the valve being adaptable to interpose the vent port between the expellant port and the reservoir.

11. A device for dispensing a product from a collapsible container by applying external pressure to the collapsible container thereby expelling the product through an application, comprising:

a pressure bottle having a receptacle for receiving a collapsible container;

a sprayer cover, removable affixed to the pressure bottle, comprising:

a water intake tube;

a rinse tube; and a hollow piercing tube, the piercing tube configured to be inserted through a portion of the collapsible container inserted in the receptacle when said sprayer cover is affixed to the pressure bottle;

an applicator wand; and a valve, adaptable to plurality of configurations, including a first configuration connecting the water intake tube between an external water source and the receptacle and connecting the hollow piercing tube between the collapsible container and the applicator wand.

12. The device for dispensing product of claim 11, wherein the plurality of configurations includes a second configuration connecting the water intake tube between the external water source and the receptacle and connecting the rinse tube between the receptacle and the applicator wand.

13. The device for dispensing product of claim 12, wherein the plurality of configurations includes a third configuration disconnecting the water intake tube from the receptacle.

14. The device for dispensing product of claim 11, wherein the plurality of configurations includes a second configuration disconnecting the water intake tube from the receptacle.

15. The device for dispensing product of claim 14, wherein the second configuration further connects the rinse tube between the receptacle and the applicator wand.

16. The device for dispensing product of claim 14, further comprising:

an off vent, wherein the second configuration further connects the off vent between the receptacle and the applicator wand.

* * * * *